US006137402A

United States Patent [19]

Marino

[11] Patent Number: 6,137,402

[45] Date of Patent: Oct. 24, 2000

[54] METHOD FOR ARMING A SECURITY SYSTEM

[75] Inventor: Francis C. Marino, Dix Hills, N.Y.

[73] Assignee: Pittway Corp., Chicago, Ill.

[21] Appl. No.: 09/261,984

[22] Filed: Mar. 4, 1999

[51] Int. Cl.[7] ..... G08B 29/00

[52] U.S. Cl. ..... 340/506; 340/507; 340/529; 340/539; 340/587; 340/825.06; 340/541

[58] Field of Search ..... 340/426, 506, 340/507, 511, 517, 529, 539, 587, 825.06, 541

[56] References Cited

U.S. PATENT DOCUMENTS 3,839,711 10/1974 Collins et al. ..... 340/567
4,179,691 12/1979 Keller ..... 340/567
4,232,308 11/1980 Lee ..... 340/539
4,517,554 5/1985 Moser et al. ..... 340/514
5,677,664 10/1997 Sawinski ..... 340/426
5,977,871 11/1999 Miller et al. ..... 340/506

*Primary Examiner*—Daryl Pope
*Attorney, Agent, or Firm*—Greenberg Traurig, LLP; Anthony R. Barkume

[57] ABSTRACT

A method of arming a security system comprising one or more send-only RF sensor. The method comprises the steps of receiving a request to arm the system from a keypad, determining if a faulted status exists in the receiver/controller, if a faulted status does exist, then changing the faulted status to a restored status, and arming the security system when there are no faulted statuses in the receiver/controller.

16 Claims, 2 Drawing Sheets

METHOD FOR ARMING A SECURITY SYSTEM

BACKGROUND OF THE INVENTION

This invention relates to wireless security systems that use send-only radio frequency (RF) sensors to indicate a fault condition in the monitored area, and in particular to wireless security systems that cannot be armed when the status signifies a fault condition. The fault condition may be detected motion, detected glass breakage, etc.

Many low cost wireless security systems use send-only RF sensor transmitters to communicate status to a receiver/control unit. The receiver/control unit monitors the status by receiving and decoding messages. When the security system is armed and a fault has been indicated in a message, the receiver/control unit initiates an alarm. For example, a motion detector transmits a fault message when motion has been detected and a restore message when the motion has ceased. Each message is generally transmitted a number of times to provide a high probability of receipt by the receiver/control unit.

Most sensor transmitters are rarely activated concurrently in typical wireless security systems, therefore the loss of a message is unusual. This may not be true for large security systems, such as those installed in a school building. In a site such as this, motion detectors are typically used to provide maximum coverage in areas that are difficult and more expensive to protect using door or window-type sensors. During the day, when the security system is not armed, many motion detectors are concurrently activated by people moving within the protected areas (i.e. changing of classes between class periods). This results in many concurrent message transmissions to the receiver/control unit, causing interference or clashing and possibly memory overflow. A loss of a restore message causes the controller to maintain a sensor faulted status. When the receiver/control unit detects a faulted status, it will not allow a user to arm the security system. In order to subsequently arm the security system, someone must re-activate the motion detector that has the faulted status associated with it. This causes a restore message to be transmitted without being interfered with by other transmitted messages, thereby causing the faulted status to be cleared. It may be possible that a number of motion detectors have failed to successfully deliver their restore messages. Each detector that has a fault status associated with it will need to be activated in order to arm the system.

It is therefore an object of the present invention to provide a method for arming a send-only RF security system regardless of lost restore messages due to clashing messages and/or RF receiver buffer storage limitations.

SUMMARY OF THE INVENTION

In accordance with these and other objects, the present invention is a method of arming a security system which comprises one or more of the following sensors: motion detectors, glass break detectors, shock sensors, wireless key fobs, and/or panic pendants. All of these sensors send fault messages when they detect a fault condition, and restore messages when the fault condition is cleared. In send-only RF security systems where there may be messages clashing or losses of messages due to memory overflow and where the receiver/controller does not have the capability to poll the sensor for its status, the receiver/controller may maintain a faulted status for one or more of the sensors because of associated lost restore messages. Since security systems can not be armed when there is a faulted status (because an alarm condition will occur immediately thereafter), the invalid faulted status maintained by the receiver/controller will keep the security system from being armed. The method of the present invention, which allows the security system to be armed in spite of a faulted status from a sensor, such as a motion detector, comprises the steps of receiving a request from a keypad to arm the system, determining if a faulted status for a sensor exists in the receiver/controller, if a faulted status does exist, then changing the faulted status to a restored status, and arming the security system when there are no faulted statuses in the receiver/controller. The steps of determining if a faulted status exists in the receiver/controller, and if a faulted status does exist, then changing the faulted status to a restored status may be repeated for any number of sensors until there is no faulted statuses in the receiver/controller. The changing of the faulted statuses to restored statuses is performed by simply changing a variable stored as a memory bit in the receiver/controller.

The present invention recognizes that some sensors, such as door detectors and window detectors, need to be physically examined when a fault condition is indicated. This is because one would-not want to leave the premises while these conditions exist. Therefore the receiver/controller has the ability to processes sensor fault conditions differently dependent on the sensor type, i.e. fault conditions from motion detectors may be disregarded, while fault conditions from door detectors may continue to keep the security system from being armed.

DETAILED DESCRIPTION OF THE PREFERRED EMBODIMENT

Figure 1:
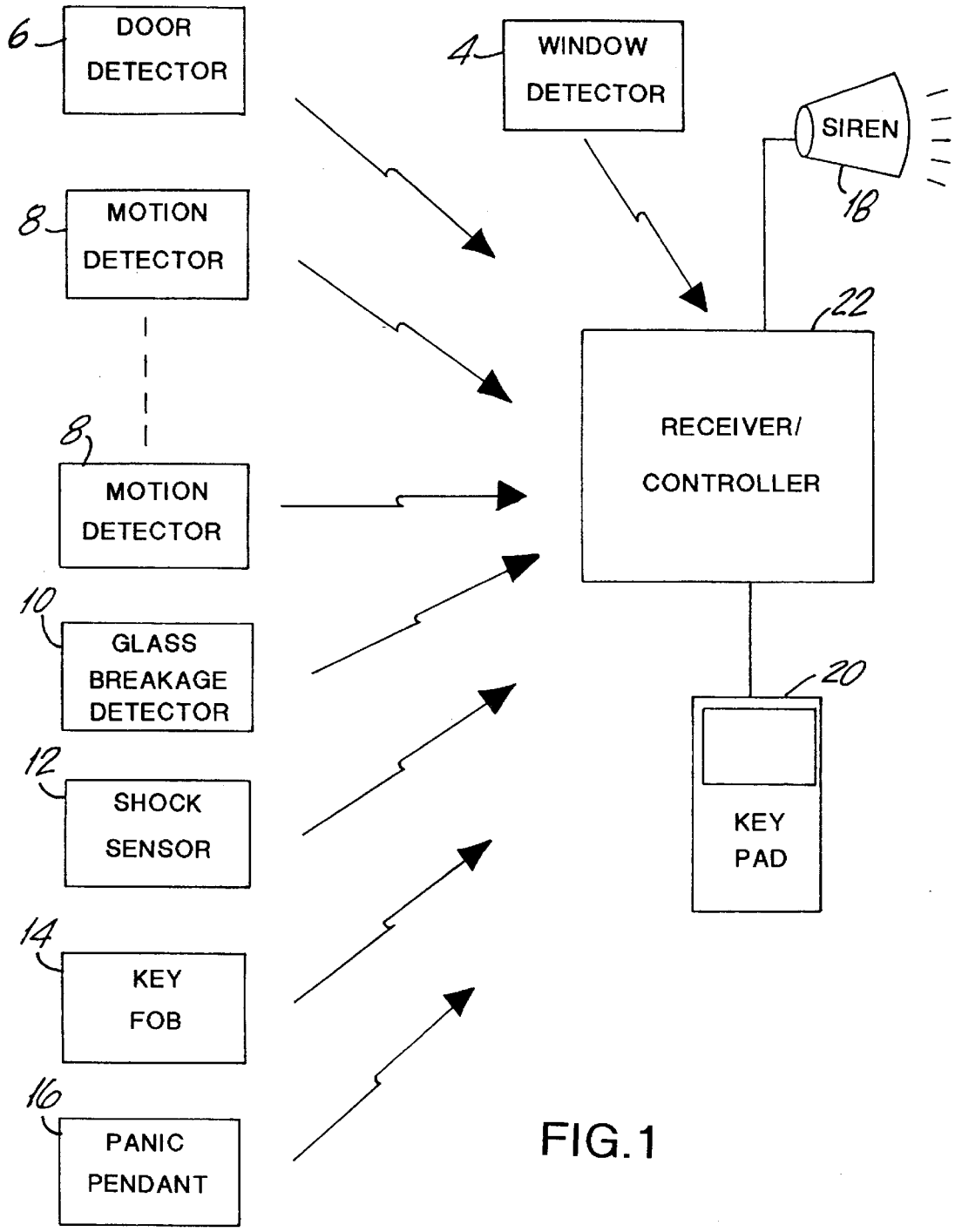
FIG. 1 is a diagram of a security system of the preferred embodiment of the present invention.

Shown in FIG. 1 are the components of a typical security system 2 comprising receiver/controller 22, keypad 20, window detector 4, door detector 6, motion detectors 8, glass breakage detector 10, shock sensor 12, key fob 14 and panic pendant 16. The sensors 4, 6, 8, 10, 12, 14, and 16 are send only sensors, transmitting RF messages to the receiver/controller 22. The receiver/controller 22 receives commands, such as arm or disarm, from the keypad 20. When the security system 2 is armed, the receiver/controller 22 processes the messages from the sensors 4, 6, 8, 10, 12, 14, and 16 and when a fault condition has been detected, i.e. glass breakage, the receiver/controller 22 transmits a signal to the siren 18. When the security system 2 is not armed, the sensors 4, 6, 8, 10, 12, 14, and 16 still transmit messages and the receiver/controller 22 still receives and processes the messages, but the siren 18 is not sounded. The messages sent by the sensors 4, 6, 8, 10, 12, 14, and 16 are transmitted a number of times to provide a high probability of the receiver/controller 22 receiving the messages. The sensors 4, 6, 8, 10, 12, 14, and 16 typically send supervision messages, fault messages and restore messages to the receiver/controller 22. The supervision messages provide sensor passive status information, the fault messages inform the receiver/controller 22 that motion (or glass breakage, or shock, etc.) has been detected in the area being monitored, and the restore messages inform the receiver/controller 22 that the motion (or glass breakage, or shock, etc.) has ceased. The operation of each of the components of the security system 2 is well known to someone skilled in the art and is not described further.

In the preferred embodiment of the present invention, the receiver/controller 22 processes the faulted status from the window detector 4 and the door detector 6 differently than from the motion detectors 8, glass breakage detector 10, the shock sensor 12, the key fob 14, and the panic pendant 16 to ensure that a window or a door is not left open while the system is armed.

The present invention addresses the problem of transmission clash or specifically loss of a restore message from a sensor 8, 10, 12, 14, or 16. This may occur when there are many sensors transmitting messages concurrently. The loss of a restore message causes the receiver/controller 22 to incorrectly maintain a faulted status for the sensor 8, 10, 12, 14, or 16. The loss of a restore message is not significant if the sensor 8, 10, 12, 14, or 16 is reactivated, causing a second restore message to be transmitted once the motion ceases and allowing the receiver/controller 22 to update the faulted status. The loss of the restore message may also occur if the memory located in the receiver/controller 22 overflows due to the volume of messages.

An example of a situation where the loss of the restore message could cause a problem is in a school building. The school building contains many motion detectors to monitor the entire site which includes hallways, stairways, and classrooms. During the school day the motion detectors are concurrently activated by many students changing classes at the same time. Concurrent activation also occurs when all of the students exit the building at the end of the school day. In a prior art security system installation, when a security guard attempted to arm the security system at the end of the day (when the building was empty), he was prevented from doing so because the receiver/controller 22 indicated a faulted condition from one or more of the motion detectors due to a loss of its associated restore message. The guard was then forced to reactivate the affected motion detector(s) causing it to transmit a restore message without concurrent sensor transmissions allowing the receiver/controller 22 to update the faulted condition. Once the erroneous faulted condition was deleted, the guard was finally able to arm the security system. In the present invention, the security system 2 may be armed regardless of missing restore messages from any number of sensors.

Figure 2:
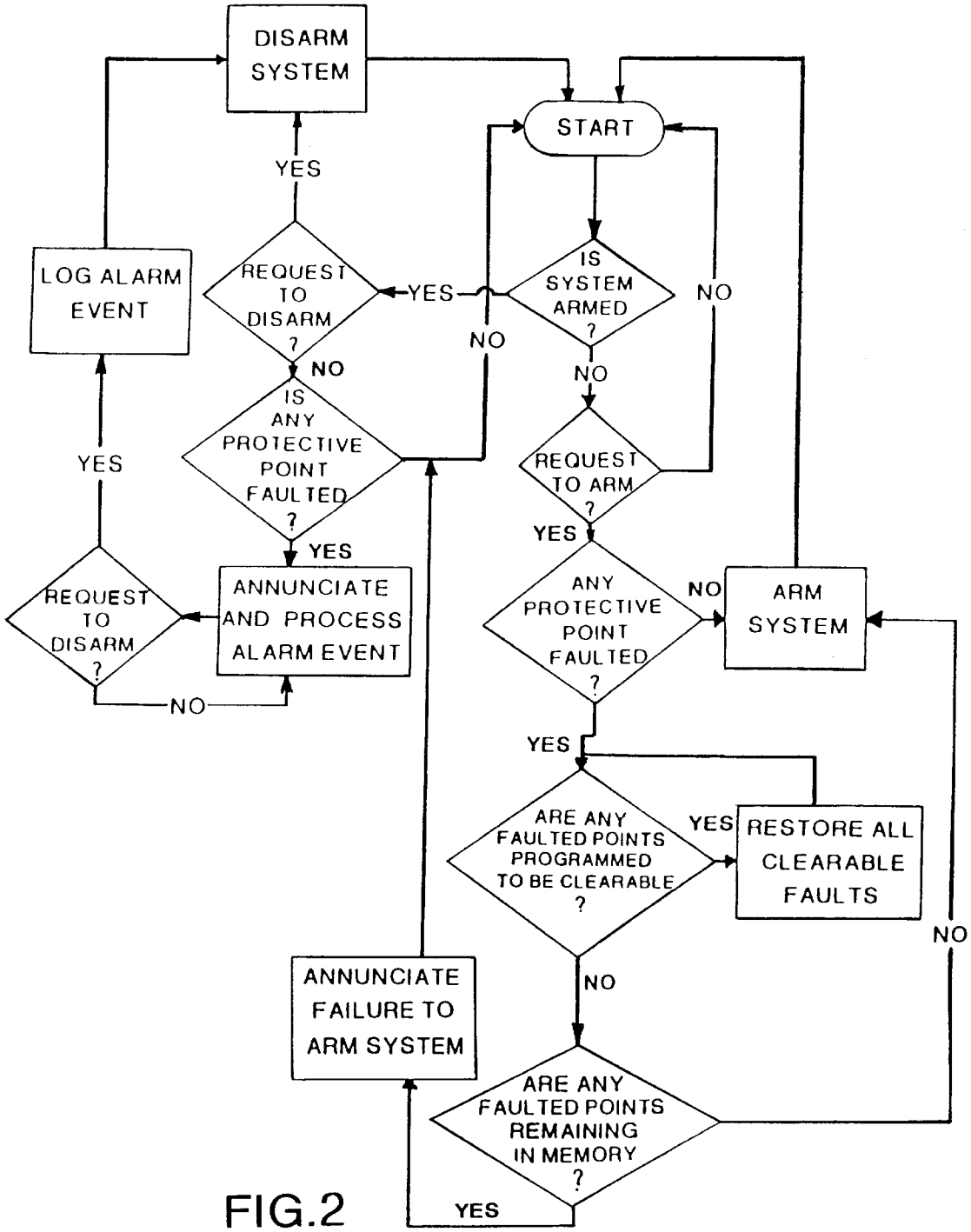
FIG. 2 is a flow chart of the operation of the preferred embodiment of the present invention.

The flowchart of the preferred embodiment of the present invention is shown in FIG. 2. Once a message has been received and decoded, the receiver/controller 22 checks if the security system 2 is armed. If it has been, it checks if the message is a request to disarm and if so, it performs the disarm routine. If it is not, the receiver/controller 22 checks if the message is a fault message. If not, the receiver/controller 22 returns to the start of the routine. If it is a fault message, the receiver/controller 22 process the message as an alarm event and waits for a request to disarm. When a request for disarm is received the receiver/controller 22 logs the alarm event, disarms the security system 2, and goes back to the start of the routine. If the security system 2 is not armed, the receiver/controller 22 checks if the received message is an arm request. If it is not, the routine is started again. If it is a request for arm, the receiver/controller 22 checks if there are any fault conditions. If not, the security system 2 is armed and the routine is restarted.

In accordance with the present invention, if there is a fault condition, then the receiver/controller 22 checks if the fault condition has been caused by one of the sensors that it has been programmed to override (i.e. sensors 8, 10, 12, 14, or 16). If the fault condition is caused by one of the sensors that it has been programmed to override, then the faulted status is overridden (i.e cleared or updated) to a restored status. This may be done for any number of sensors 8, 10, 12, 14, and 16. The subsequent changing of the faulted status to a restored status is performed by changing a variable stored in memory for those sensors. Once the faulted status from the sensors 8, 10, 12, 14, and 16 are cleared, the receiver/controller 22 checks if there are any other fault conditions (i.e. smoke), and if there are the receiver/controller 22 performs the failure to arm routine and restarts. If there are no more faulted statuses, the system is armed and the routine is restarted.

If the faulted status was caused by a sensor that the receiver/controller 22 has not been programmed to override, then it will not clear the fault status to a restored status, but must wait for the particular sensor to transmit a restore message. This may occur in the case of a door sensor, where the user attempting to arm the system will have to investigate the area, and close the door to cause it to transmit a restore message and allow the system to be armed.

It will be apparent to those skilled in the art that modifications to the specific embodiment described herein may be made while still being within the spirit and scope of the present invention. For example, the present invention is disclosed for a send-only RF security system, but may also be used in other types of security systems. Also the security system may include other components such as a wireless keypad or a dialer. Although the intent of the present invention is to ignore incorrect faulted statuses from the motion detectors 8, glass breakage detector 10, the shock sensor 12, the key fob 14, and the panic pendant 16, the present invention may also be used to ignore faulted statuses from the window detector 4 and the door detector 6. Lastly, the flow of operations may be performed differently.

I claim:

1. In a security system comprising one or more sensors, said sensors transmitting RF signals, said RF signals including fault messages and restore messages, and an RF receiver/controller for receiving and processing said fault and restore messages to provide a faulted status or a restored status for each sensor; a method of arming said security system comprising the steps of:

a) receiving a request from a user to arm the system, b) determining if a faulted status exists in the receiver/controller, at the time the receiver/controller received the request to arm the system, c) if a faulted status exists at the time the receiver/controller received the request to arm the system, then automatically changing said faulted status to a restored status without requiring the detection of a restore message from a sensor, and d) arming said security system when there are no faulted statuses in the receiver/controller.

2. The method of claim 1 further comprising the repeating of steps b and c until there is no faulted statuses in the receiver/controller.

3. The method of claim 1 wherein said sensor is a motion detector.

4. The method of claim 1 wherein said sensor is a glass break detector.

5. The method of claim 1 wherein said sensor is a shock sensor.

6. The method of claim 1 wherein said sensor is a wireless key fob.

7. The method of claim 1 wherein said sensor is a panic pendant.

8. The method of claim 1 wherein the step of automatically changing said faulted status to a restored status without requiring the detection of a restore message from a sensor is only carried out if the faulted status is associated with a motion detector.

9. A security system comprising:

a) a sensor device comprising:

i) sensor means for detecting a fault condition in an area of interest, and ii) means for transmitting an RF signal from said sensor means in response to detecting said fault condition, said RF signal containing a fault message upon fault condition detection, and said RF signal containing a restore message upon detection of cessation of said fault condition, and b) a receiver/controller comprising:

i) means for receiving said RF signal, ii) means for processing said RF signal to provide a faulted status in response to a fault message and a restored status in response to a restore message, iii) means for receiving a request from a user to arm the security system, iv) means for determining if a faulted status exists, v) means for automatically changing said faulted status to a restored status when said faulted status exists at the time a request to arm is received, and vi) means for arming said security system when there is no faulted status.

10. The security system of claim 9 further comprising a plurality of sensor devices.

11. The security system of claim 9 wherein said sensor device is a motion detector.

12. The security system of claim 9 wherein said sensor device is a glass break detector.

13. The security system of claim 9 wherein said sensor device is a shock sensor.

14. The security system of claim 9 wherein said sensor device is a wireless key fob.

15. The security system of claim 9 wherein said sensor device is a panic pendant.

16. The security system of claim 9 further comprising means for determining if an existing faulted status is associated with a motion detector and wherein said means for automatically changing said faulted status to a restore status only changes said faulted status to a restore status when said faulted status is determined to be from a motion detector.

* * * * *

UNITED STATES PATENT AND TRADEMARK OFFICE

CERTIFICATE OF CORRECTION

PATENT NO. : 6,137,402

DATED : October 24, 2000

INVENTOR(S) : Marino

It is certified that error appears in the above-identified patent and that said Letters Patent are hereby corrected as shown below:

In Claim 9.b) v), Line 2: " when" should be written as "as a result of"
In Claim 9, Line b) v), Line 2: "exists" should be written as "existing"

Signed and Sealed this

Eighth Day of May, 2001

*Attest:*

Nicholas P. Godici

NICHOLAS P. GODICI

*Attesting Officer*

*Acting Director of the United States Patent and Trademark Office*